US005524680A

United States Patent [19]

de Laforcade

[11] Patent Number: 5,524,680

[45] Date of Patent: Jun. 11, 1996

[54] DEVICE FOR DISPENSING A DOSE OF GIVEN VOLUME OF A LIQUID OR PASTY PRODUCT

[75] Inventor: Vincent de Laforcade, Rambouillet, France

[73] Assignee: L'Oreal, Paris, France

[21] Appl. No.: 229,831

[22] Filed: Apr. 19, 1994

[30] Foreign Application Priority Data

May 10, 1993 [FR] France ..... 93 05562

[51] Int. Cl.[6] ..... B65B 1/04; B65B 3/04; B65B 31/00

[52] U.S. Cl. ..... 141/18; 141/22; 141/59; 141/113; 141/312; 141/325; 141/326; 141/349; 141/351; 141/365; 141/366

[58] Field of Search ..... 141/18, 20, 21, 141/22, 23, 59, 113, 312, 325, 326, 327, 348, 349, 350, 351, 359, 360, 361, 365, 366; 222/321; 220/675

[56] References Cited

U.S. PATENT DOCUMENTS

| | | | |
|---|---|---|---|
| 3,559,701 | 2/1971 | Wittersheim | 141/20 |
| 3,680,605 | 8/1972 | Nigro | 141/20 |
| 3,718,165 | 12/1970 | Grothoff | 141/20 |
| 4,610,366 | 9/1986 | Estes et al. | 220/675 |
| 5,179,982 | 1/1993 | Berube et al. | 141/20 |
| 5,305,810 | 4/1994 | Meshberg | 141/18 |

FOREIGN PATENT DOCUMENTS

| | | |
|---|---|---|
| 2556091 | 6/1985 | France . |
| 2229380 | 9/1990 | United Kingdom . |

*Primary Examiner*—Henry J. Recla
*Assistant Examiner*—Timothy L. Maust
*Attorney, Agent, or Firm*—Young & Thompson

[57] ABSTRACT

Device for dispensing a dose of given volume of a liquid or pasty product, including:

a receptacle (2) equipped with a first pump (4) including a hollow control rod (5) for transfering the product from the receptacle (2) into the bottle (3) by forcing;

a bottle (3) equipped at one end with a second pump (15) and with a dispensing head (14), the bottle having, at the other end, a bottom (17), designed to interact with the end of the control rod (25) of the first pump (4) and including a valve which opens only under the pressure of the product contained in the receptacle (2)when the first pump (4) is actuated.

13 Claims, 4 Drawing Sheets

DEVICE FOR DISPENSING A DOSE OF GIVEN VOLUME OF A LIQUID OR PASTY PRODUCT

FIELD OF THE INVENTION

The invention relates to a device for dispensing a dose of given volume of a liquid or pasty product, including a receptacle capable of containing several doses of product, a bottle capable of containing a single dose of product, a means for transferring the product from the receptacle into the bottle, and a means for dispensing the dose of product from the bottle.

BACKGROUND OF THE INVENTION

It is often necessary to take a dose of precisely given volume from a storage receptacle containing a great many doses. This is the case, in particular, in hairdressing salons or beauty parlours; it is preferable to show the customer that he or she really has received, during the treatment, the suitable dose of product for which he or she has been billed, whereas the product is stored in much larger receptacles.

There is proposed in FR-A-2,556,091 a device of this type in which the product is taken from a receptacle with the aid of a bottle of the syringe type including a piston and an opening located at one end of the bottle, and the product is dispensed via the same end by pushing back the piston. This device makes it possible to distribute the product but does not make it possible to dispense the product by spraying, which is the most generally used method of dispensing.

The present invention relates to a device which makes it possible to dispense the product by spraying.

SUMMARY OF THE INVENTION

The subject of the present invention is a device for dispensing a dose of given volume of a liquid or pasty product, including a receptacle capable of containing several doses of product, a bottle capable of containing a single dose of product, a means for transferring the product from the receptacle into the bottle, and a means for dispensing the product from the bottle, it being possible for the bottle to be fixed removably to the receptacle and to slide longitudinally with respect to the receptacle, characterized in that:

- the receptacle is equipped with a first pump including a hollow control rod for transferring, by forcing, the product from the receptacle into the bottle;
- the bottle is equipped at one end with a second pump and with a dispensing head for dispensing the dose of product from the bottle, the bottle having, at the other end, a bottom designed to interact with the end of the control rod of the first pump and including a valve sealing off a passage for communication between the bottle and the receptacle, and opening only under the pressure of the product contained in the receptacle when the first pump is actuated.

Thus, according to the invention, the device includes two pumps, a first pump for transferring the product from the receptacle into the bottle by forcing, and a second pump for carrying out the dispensing; the means for transferring the product from the receptacle into the bottle consists of the first pump interacting with the valve in the bottom of the bottle.

The first pump is preferably a pump termed "high delivery" pump, which makes it possible to fill the bottle by actuating the pump only once or twice. For example, a pump is suitably used having a delivery of 5 to 10 ml per shot in order to feed a 10 ml bottle.

Advantageously, the first pump is fixed to the mouth of the receptacle removably, it being possible for the pump and the receptacle to be separated. According to a preferred embodiment, the first pump is carried by a component forming a plug including a fixing skirt closed by a wall perpendicular to the said skirt and equipped with an opening for the passage of the bottle when the control rod of the first pump is inside the receptacle or for mounting the first pump when the control rod is outside the receptacle, the component forming a plug being screwed or snap-fitted onto the mouth of the receptacle. This component is also advantageously secured to a guide component for guiding the sliding of the bottle with respect to the receptacle. The guides may be located inside or outside the receptacle.

On the mouth of the bottle is located the second pump which has a smaller delivery than the first pump and which can be actuated manually from outside with the aid of a push button carried by the dispensing head. The dispensing head is equipped with a dispensing passage opening directly to outside, particularly in the case where the product to be dispensed is creamy or pasty, or with a passage equipped with a dispensing nozzle for spraying the product to be dispensed when the product is liquid.

The bottom of the bottle is advantageously a component fixed, preferably removably, onto the bottle, the bottle being open at the opposite end from that which carries the dispensing head.

The valve located on the bottom of the bottle is preferably a valve including a moving body, advantageously a ball, resting on a seat, the moving body being held in place by an elastic means such as a strip or a coil spring.

Preferably, the outer face of the bottom of the bottle is provided with a hollow indentation or cavity which has a complementary shape to that of the end of the rod of the first pump. The passage which can be sealed off by the valve opens into this indentation, which makes it possible to place the receptacle and the bottle in communication.

The bottle is preferably equipped with vents close to the dispensing head.

The bottle is advantageously equipped with a swelling close to the dispensing head, so as to fill the bottle reliably up to a given level and to prevent the product from coming out of the vents.

According to one embodiment of the device of the invention, the bottle contains a free piston which is pushed by the product when the bottle is filled and which follows the product throughout the dispensing period. Preferably, the free piston at the end of travel compresses a spring located in the bottle close to the dispensing head.

The device according to the present invention operates in the following way: when the user wishes to fill the bottle, he or she fixes it onto the receptacle so that the end of the rod of the first pump interacts with the bottom of the bottle, then he or she presses on the bottle so as to drive in the rod of the first pump, the bottle sliding longitudinally with respect to the receptacle. The product contained in the receptacle leaves via the rod and opens the valve located in the bottom of the bottle sealing off the passage for communication between the bottle and the receptacle, and fills the bottle. The user possibly continues the pumping operation until the bottle is completely full. He or she separates the bottle from the receptacle and, in order to dispense the dose of product contained in the bottle, he or she actuates the second pump. The user is then certain of dispensing a given dose of product.

BRIEF DESCRIPTION OF THE DRAWINGS

In order to make the invention easier to understand, several embodiments thereof, represented in the appended drawings, will be described hereafter, purely by way of non-limiting illustration.

In this drawing.

DETAILED DESCRIPTION OF THE INVENTION

Figure 1:
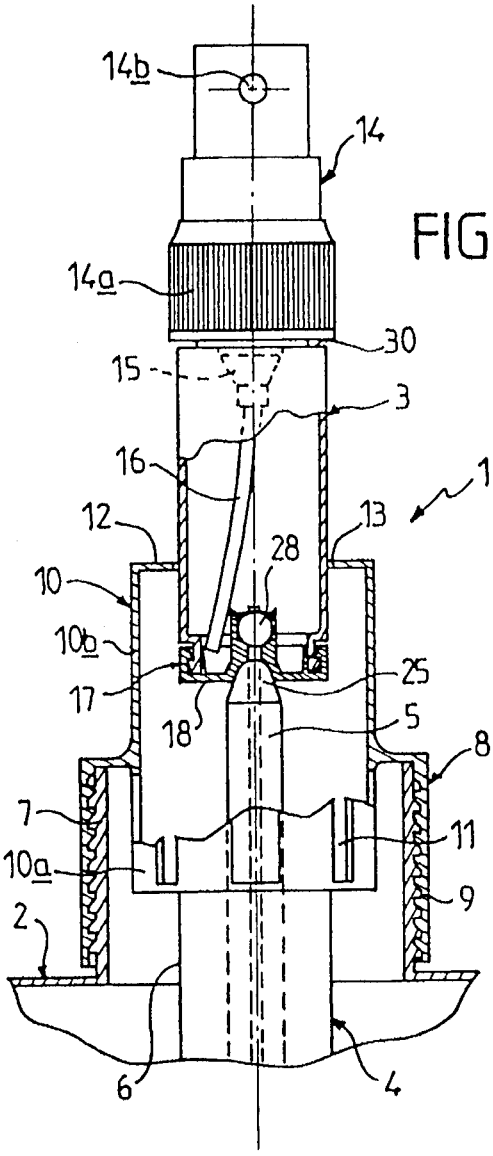
FIGS. 1 to 3 represent, in partial cutaway side view, a first embodiment of a device according to the invention, FIG. 1 being a view of the mounted device in the rest position, FIG. 2 a view of the device during filling of the bottle, and FIG. 3 a detailed view of the bottom of the bottle on a larger scale.
Figure 2:
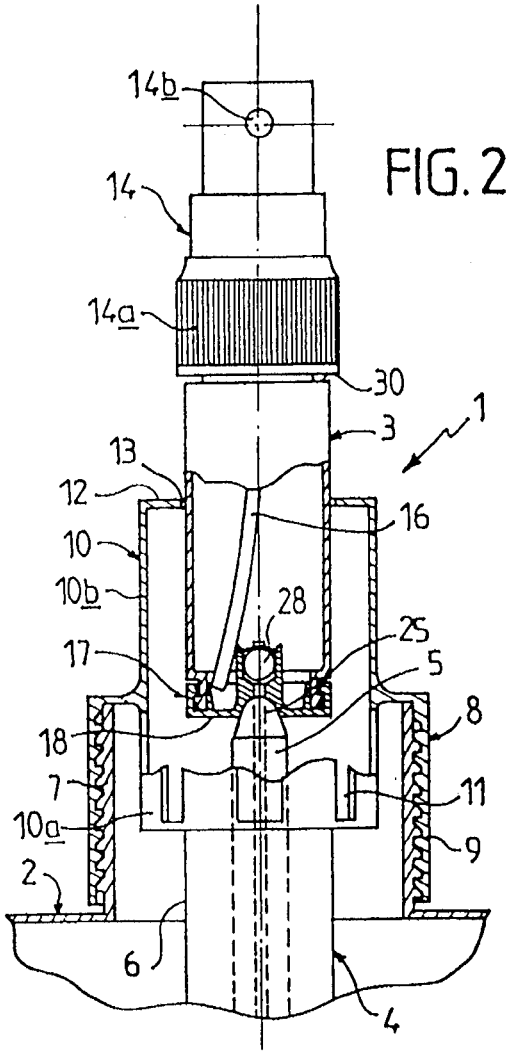
Figure 3:
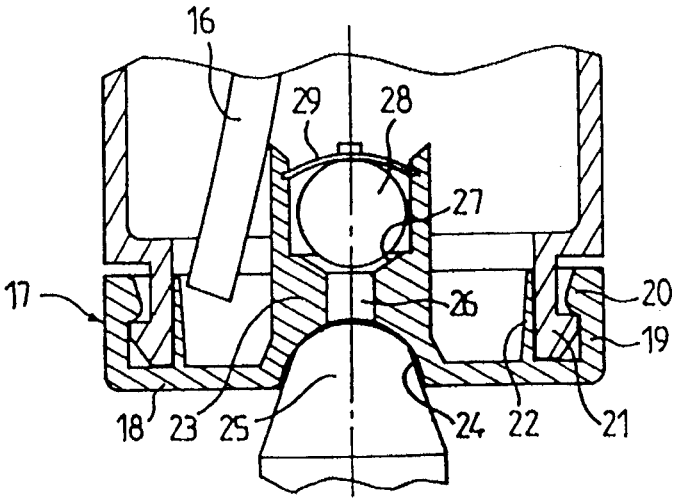

FIGS. 1 to 3 represent a device which is denoted overall by the reference 1. The device 1 is composed of a receptacle 2 and of a bottle 3. The receptacle 2 includes a pump 4 equipped with a hollow control rod 5 sliding in a pump body 6. The pump 4 is fixed by screwing on to the mouth 7 of the receptacle 2 with the aid of a fixing component 8 forming a plug which is secured to the pump body 6; the fixing component 8 includes a first cylindrical skirt 9 carrying, on its internal face, a screw thread corresponding to that of the mouth 7, and a second skirt 10 which is also cylindrical of smaller diameter than that of the skirt 9. A part 10*a* of the skirt 10 extends inside the mouth 7 of the receptacle 2 where it is attached to the pump body 6. Slits 11 are made in this inside part 10*a* of the skirt 10. The part 10*a* of the skirt 10 extends outside the mouth 7 of the receptacle 2 and at its upper part (in the position represented in FIGS. 1 and 2) carries a transverse closure face 12, situated in a plane perpendicular to the axis of the skirt 10, closing the fixing component forming a plug 8 of the pump 4. In the closure face 12 is formed a circular opening 13 having a diameter allowing the passage of the bottle 3 through the opening 13.

A pump 15 and a dispensing head 14 carrying a spray nozzle 14*b* are fixed to the mouth of the bottle 3. The pump 15 is connected to a dip tube 16. A fixing ring 14*a* which is ribbed in order to facilitate gripping thereof, is provided for fixing, by screwing, the dispensing head 14 on to the mouth with which the bottle 3 is equipped. To the lower part of the bottle 3 is fixed, by snap-fitting, a bottom 17 which is represented in more detail in FIG. 3. This bottom 17 is made up of a disc 18 carrying at its periphery a skirt 19 extending perpendicularly to the disc 18 towards the bottle 3; it is internally equipped with a bead 20 intended to interact with a complementary bead 21 located at the lower part of the bottle 3, the outer surface of the skirt 19 then being in the extension of the lateral wall of the bottle 3. A cylindrical sealing lip 22 fixed to the disc 18 interacts with the inner wall of the bead 21. At the center of the disc 18 there emerges a column 23 extending axially towards the inside of the bottle. The outer wall of the column 23 is cylindrical and connects with the disc 18 via a cone frustum-shaped flared part. At the base of the column 23 and in the disc 18 is formed an indentation or cavity 24 of circular overall shape, into which the end 25 of the rod 5 can fit, which rod has a complementary circle shape, when the bottle 3 is mounted on the receptacle 2. In the column 23 is defined a passage 26 emerging, on one side, in the indentation 24 and, on the other, into a widened inside space receiving a ball 28 and connected to the passage 26 by a conical bearing surface 27 acting as a seat for the ball 28. The ball 28 is held by an elastic strip 29, the ends of which are inserted into the inside wall of the column 23.

The bottle 3 is equipped with a vent, made up of a groove (not represented) formed in the transverse shoulder 30 of the bottle 3 at the base of the mouth of the bottle 3.

The device 1 operates in the way described hereafter. When the user wishes to fill the bottle 3 with a dose of product, he or she inserts this bottle into the receptacle 2 through the opening 13 until the cavity 24 comes into contact with the end of the rod 5. When the bottle 3 is in place, he or she drives the bottle 3 into the longitudinal receptacle 2 by sliding until the fixing ring 14*a* of the dispensing head 14 comes into abutment on the surface 12. The bottle 3 pushes back the rod 5 and the first pump 4 is actuated. The liquid under pressure leaves via the rod 5, passes into the passage 26 and pushes back the ball 28 which elastically deforms the strip 29. The passage 26 is open and the liquid penetrates into the bottle 3. The groove formed in the shoulder 30 of the bottle 3 allows the air compressed by the arrival of the liquid, to escape. The user possibly repeats this pumping operation until the bottle 3 is full. After each pumping operation, the ball 28 falls back on to its seat 27 where it is held in place by the strip 29. The bottle 3 is therefore closed in leaktight fashion.

In order to dispense the dose of liquid contained in the bottle 3, the user takes the bottle 3 back out of the receptacle 2, transports it to the dispensing site and actuates the pump 15, by pressing on the push button of the dispensing head 14. The liquid is sprayed through the nozzle 14*b*.

Figure 4:
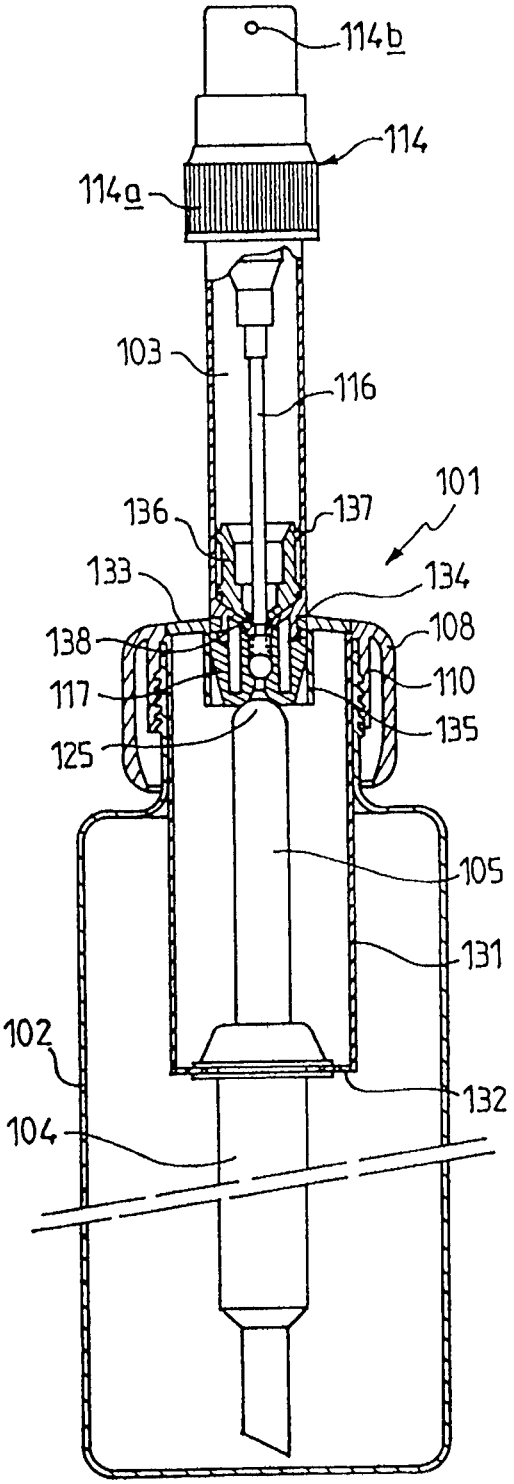
FIGS. 4 to 6 represent another embodiment of a device according to the invention, in which the bottle contains a piston, FIG. 4 being a partially cutaway side view of the device at rest before the bottle is filled, FIG. 5 a partial view in longitudinal section after filling of the bottle, and FIG. 6 a detailed view of the bottom of the bottle on a larger scale.
Figure 5:
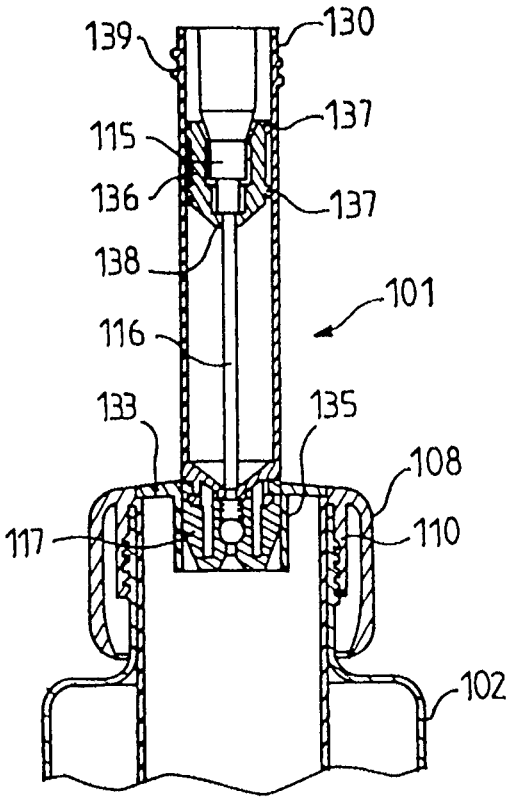
Figure 6:
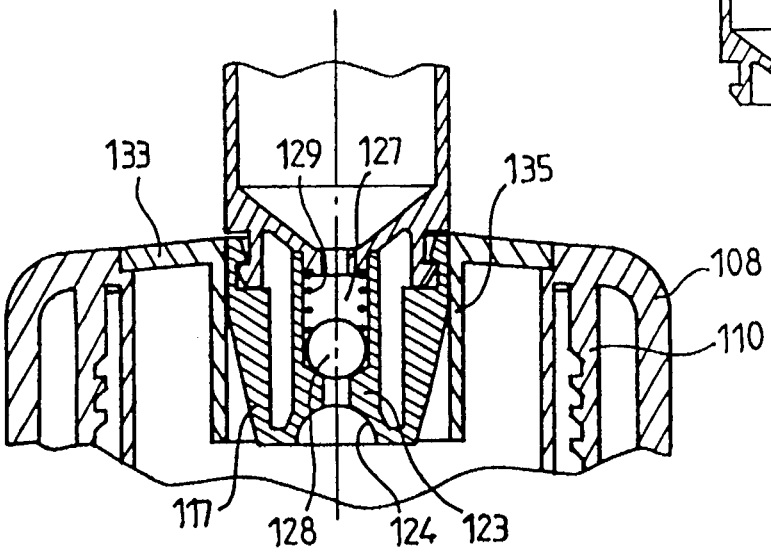

FIGS. 4 to 6 represent another embodiment of the device according to the invention, in which the bottle contains a free piston. The device is denoted overall by the reference 101. It includes a receptacle 102 on which a bottle 103 is fixed. On the mouth of the receptacle 102 is fixed a pump 104 with the aid of a fixing component 108 forming a plug. This component 108 includes a cylindrical skirt 110 carrying an internal screw thread interacting with an external screw thread on the neck of the receptacle 102, and a cylindrical basket 131 located in the mouth of the receptacle 102 and having, to within the necessary clearance, a diameter equal to the inside diameter of the mouth of the receptacle 102. The basket 131 carries the pump 104, the rod 105 of the pump extending into the inside volume of the basket 131. At the lower part of the basket 131 are formed vents 132 allowing the product which may have been able to penetrate into the space inside the basket 131 to be discharged. The fixing component 108 is capped by a guide component 133 which includes a circular axial opening 134 from which a guide skirt 135, pointing towards the inside of the receptacle 102, extends. The bottle 103 is equipped with a bottom 117 fixed by snap-fitting on to the lower edge of the lateral wall of the bottle 103 in the same way as the bottom 17 of the preceding variant. The bottom 117 has a cylindrical overall shape ending in a conical tip pointing towards the inside of the receptacle so as to facilitate its introduction into the receptacle 102. The hollow central column 123 defines a passage opening on the outside into a hemispherical cavity 124 having a shape complementary to that of the end 125 of the rod 105 and on the other side into a chamber 127 communicating with the cavity 124 and equipped with a seat for a ball 128. A spring 129 holds the ball on its seat. At the upper part, the bottle 103 is equipped with a pump 115 actuated by a dispensing head 114 equipped with a spray nozzle 114*b* and with a ribbed fixing ring 114*a*. The pump is connected to a rigid dip tube 116. Vents 130 are formed at the upper part of the wall of the bottle 103. A piston 136 having a cylindroconical shape is capable of sliding around the dip tube 116 of the pump 115. The cylindrical part of the piston 136 is equipped with outer lips 137 which seal against the internal wall of the bottle 103, and internal lips 138 which seal against the dip tube 116 of the pump 115. A spring 139 surrounds the body of the pump 115 at the upper part of the bottle 103.

The device 101 operates in a similar way to the device 1. The user drives the bottle 103 into the receptacle 102 until the end 125 of the rod 105 is placed in the cavity 124. The user then pushes the bottle 103 in order to actuate the pump 104 by driving the rod 105 in until the dispensing head 114 comes into abutment on the guide component 133. The pressurized liquid contained in the receptacle 102 pushes back the ball 128 which compresses the spring 129. The liquid penetrates into the bottle 103 and lifts the piston 136 which, at the end of the filling of the bottle 103, compresses the spring 139. The air compressed above the piston 136 escapes through the vents 130.

In order to use the dose in the bottle 103, the user separates the bottle 103 from the receptacle 102 and transports it to the dispensing site where he or she actuates the pump 115 with the aid of the dispensing head 114 in order to spray the liquid through the nozzle 114*b*. During spraying, the free piston 136 drops back down and when the dose has been used up resumes its place at the lower part of the bottle 103.

The spring 139 allows the air to enter through the internal air intake and not through the ball valve as soon as the pump 115 is actuated.

The presence of the free piston 136 which is in permanent contact with the liquid allows the bottle 103 to be used equally well head down as head up, which often facilitates application, for example in hairdressing.

Figure 7:
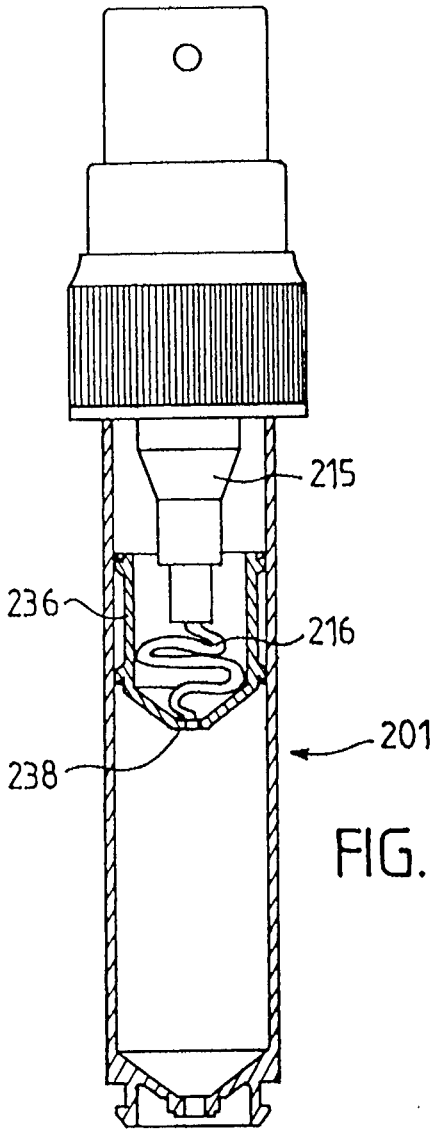

FIG. 7 partially represents a device 201 which is a variant of the device 101 in which the dip tube 216 of the pump 215 is flexible and interacts with the opening 238 in the piston 236.

Figure 8:
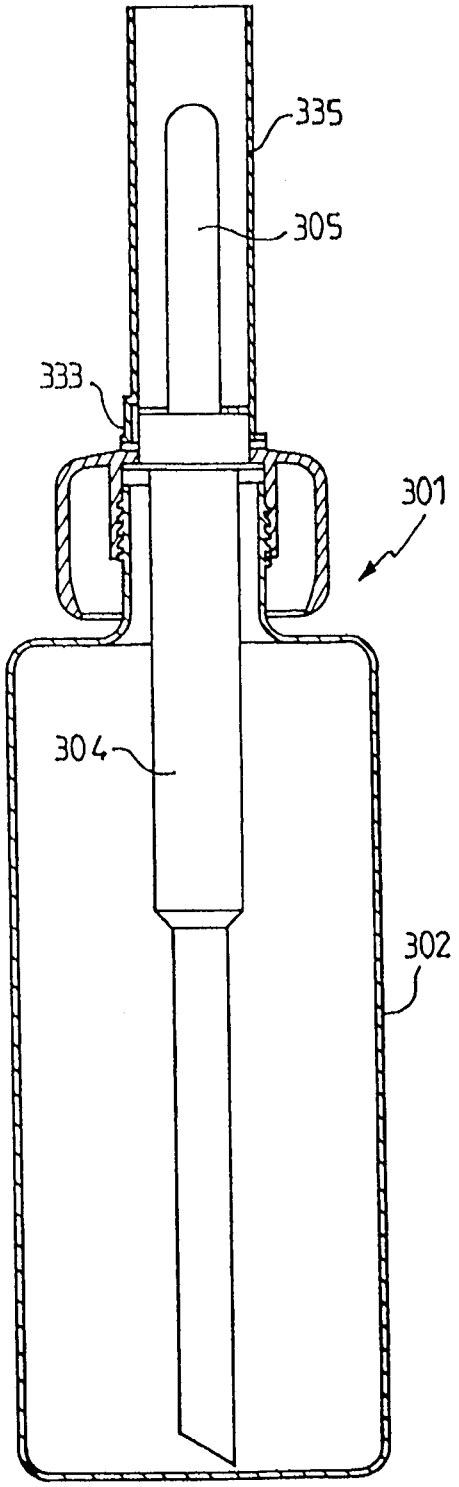
FIGS. 7 and 8 are views in longitudinal section of variants of the second embodiment.

FIG. 8 partially represents a device 301 which is a variant of the device 101 in which the rod 305 of the pump 304 is situated outside the receptacle 302 and in which the guide skirt 335 of the guide component 333 of the bottle is outside the receptacle 302 and protects the rod 305.

Figure 9:
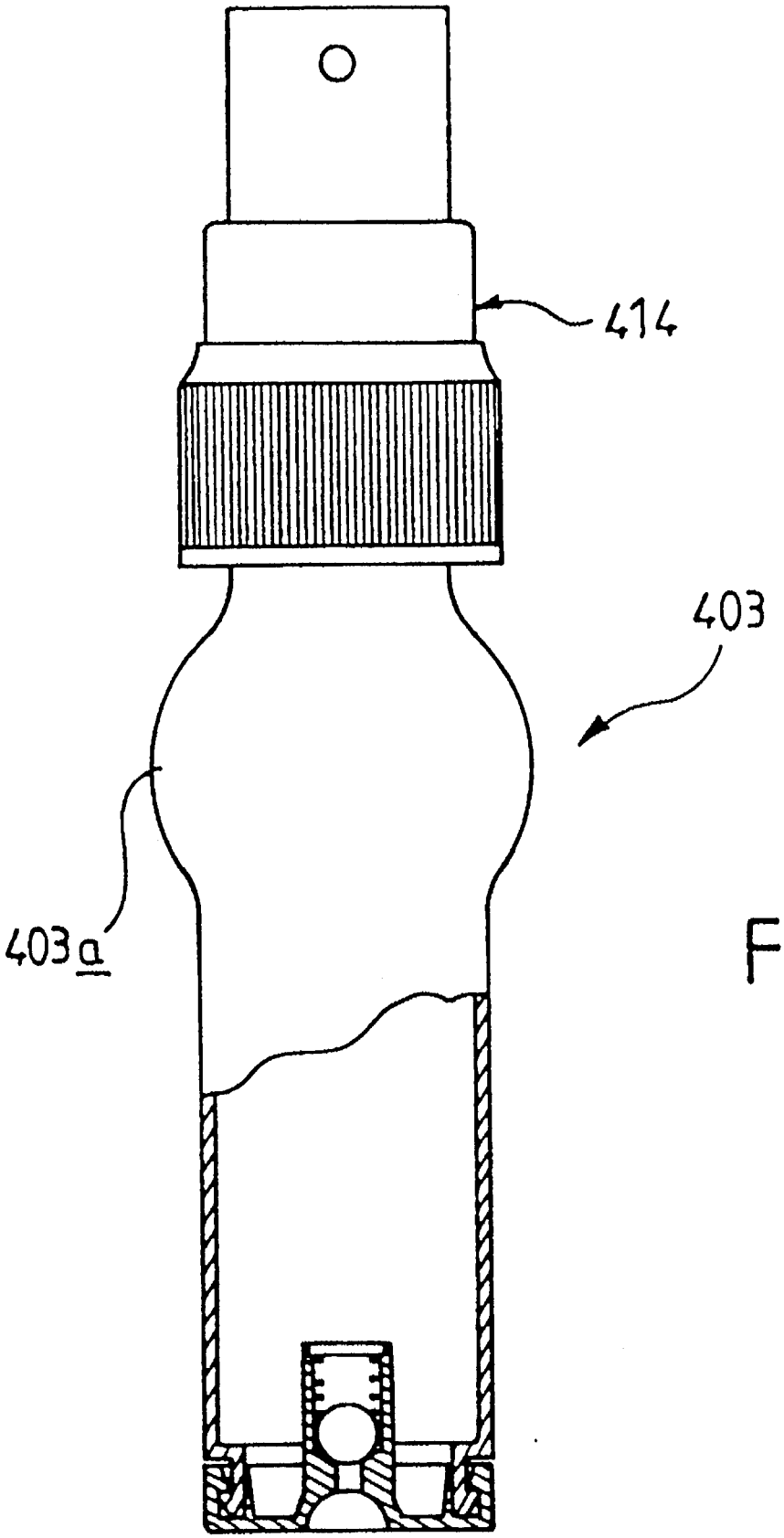
FIG. 9 is a view in longitudinal section of another bottle variant.

FIG. 9 represents another embodiment of the bottle. The bottle 403 includes a swelled part 403*a* close to its end carrying the dispensing head 414. This swelled part 403*a* makes it possible to fill the bottle 403 more reliably up to a precisely given level. Indeed, after having reached the lower part of the swelled part, the level of the product to be dispensed rises more slowly in the bottle and makes it easier to stop it. Moreover, it is possible to avoid the level rising as far as the vents (not represented) formed at the upper part of the bottle.

I claim:

1. In a device for dispensing a dose of given volume of a product, comprising a receptacle (2, 102) capable of containing several doses of product, a bottle (3,103) capable of containing a single dose of product, a means for transferring the product from the receptacle (2, 102) into the bottle (3, 103), and a means for dispensing the dose of product from the bottle (3, 103), said bottle (3, 103) adapted to be fixed removably to the receptacle (2, 102) and to slide longitudinally with respect to said receptacle (2, 102), the improvement wherein:

the receptacle (2, 102) is equipped with a first pump (4, 104) including a hollow control rod (5, 105) for transferring, by forcing, the product from the receptacle (2, 102) into bottle (3, 103);

the bottle (3, 103) is equipped at one end with a second pump (15, 115) and with a dispensing head (14, 114) for dispensing the dose of product from the bottle (3, 103), said bottle having, at the other end, a bottom (17, 117) designed to interact with an end of the control rod (25, 125) of the first pump (4, 104) and including a valve sealing off a passage (26) for communication between the receptacle (2, 102) and the bottle (3, 103) formed in said bottom (17, 117), and opening only under the pressure of the product contained in the receptacle (2, 102) when the first pump (4, 104) is actuated.

2. Device according to claim 1, wherein the first pump (4, 104) is carried by a component (8, 118) forming a plug including a skirt (9) for fixing on to the receptacle, said component being closed by a wall (12) perpendicular to said skirt and equipped with an opening (13).

3. Device according to claim 2, wherein the component forming a plug is secured to a guide component (133, 333) for guiding the sliding of the bottle (103).

4. Device according to claim 1, wherein the bottom (17, 117) of the bottle is a separate component.

5. Device according to claim 1, wherein the valve located in the bottom of the bottle includes a moving body (28, 128) resting on a seat (27, 127), said moving body (28, 128) being held by an elastic means (29, 129).

6. Device according to claim 5, wherein moving body is a ball (28, 128).

7. Device according to claim 5, wherein the elastic means is a strip (29).

8. Device according to claim 5, wherein the elastic means is a spring (129).

9. Device according to claim 1, wherein an outer face of the bottom (17, 117) of the bottle is provided with an indentation (24, 124) into which opens said passage which can be sealed off by the valve and the end of the rod (25, 125) of the first pump (4, 104) has a complementary shape to that of the indentation (24, 124).

10. Device according to claim 1, wherein the bottle (3, 103) is equipped with vents (30, 130) close to the dispensing head (14, 114).

11. Device according to claim 1, wherein the bottle (103) contains a free piston (136).

12. Device according to claim 11, wherein the bottle contains, close to the dispensing head (114), a spring (139) located so that the free piston (136) compresses said spring at the end of travel.

13. Device according to claim 1, wherein the bottle (403) has a swelling (403*a*) close to the dispensing head (414).

* * * * *